US011788373B2

(12) United States Patent
McColl

(10) Patent No.: US 11,788,373 B2
(45) Date of Patent: Oct. 17, 2023

(54) EMERGENCY DISCONNECT SYSTEM

(71) Applicant: MAERSK DRILLING A/S, Kgs. Lyngby (DK)

(72) Inventor: Allan McColl, Glasgow (GB)

(73) Assignee: NOBLE DRILLING A/S, Kgs. Lyngby (DK)

( * ) Notice: Subject to any disclaimer, the term of this patent is extended or adjusted under 35 U.S.C. 154(b) by 0 days.

(21) Appl. No.: 17/892,474

(22) Filed: Aug. 22, 2022

(65) Prior Publication Data

US 2023/0123839 A1 Apr. 20, 2023

Related U.S. Application Data

(63) Continuation of application No. 16/970,321, filed as application No. PCT/DK2019/050050 on Feb. 14, 2019, now Pat. No. 11,421,503.

(30) Foreign Application Priority Data

Feb. 14, 2018 (DK) ..... PA 2018 00076
May 7, 2018 (DK) ..... PA 2018 00202

(51) Int. Cl.
*E21B 33/064* (2006.01)
*E21B 33/038* (2006.01)
(Continued)

(52) U.S. Cl.
CPC ..... *E21B 33/064* (2013.01); *E21B 33/038* (2013.01); *E21B 17/01* (2013.01);
(Continued)

(58) Field of Classification Search
CPC ..... E21B 33/064; E21B 33/038; E21B 17/01; E21B 17/085; E21B 33/0355; E21B 33/061; E21B 29/12
See application file for complete search history.

(56) References Cited

U.S. PATENT DOCUMENTS 4,317,174 A * 2/1982 Dean ..... E21B 47/001 405/195.1
5,978,739 A * 11/1999 Stockton ..... E21B 47/001 702/6

(Continued)

FOREIGN PATENT DOCUMENTS

AU 2011253837 A1 7/2012
GB 2 483 788 A 3/2012

(Continued)

OTHER PUBLICATIONS

Danish Patent Application No. PA 2018 00076; Search Opinion dated Aug. 30, 2018, 4 pgs.

(Continued)

*Primary Examiner* — James G Sayre
(74) *Attorney, Agent, or Firm* — Cozen O'Connor

(57) ABSTRACT

A control system for controlling disconnection of riser system that extends between a vessel and a subsea location that comprises a wellbore, the riser system configured to receive a string in use, the control system being configured to disconnect the riser system according to a sequence of operations, the sequence of operations comprising disconnecting the riser system prior to or simultaneous with cutting the string and sealing the well bore.

20 Claims, 5 Drawing Sheets

(51) Int. Cl.

| | |
|---|---|
| ***E21B 17/01*** | (2006.01) |
| ***E21B 17/08*** | (2006.01) |
| ***E21B 33/035*** | (2006.01) |
| ***E21B 33/06*** | (2006.01) |

(52) U.S. Cl.
CPC ..... *E21B 17/085* (2013.01); *E21B 33/0355* (2013.01); *E21B 33/061* (2013.01)

(56) References Cited

U.S. PATENT DOCUMENTS

| | | | | |
|---|---|---|---|---|
| 6,568,476 | B1 * | 5/2003 | Andersen | E21B 33/038 166/345 |
| 9,783,199 | B2 * | 10/2017 | Martin | G05D 1/0208 |
| 2003/0230409 | A1 * | 12/2003 | Guesnon | E21B 19/002 166/250.01 |
| 2004/0099420 | A1 | 5/2004 | Kotrla et al. | |
| 2006/0065401 | A1 | 3/2006 | Allen et al. | |
| 2012/0048566 | A1 * | 3/2012 | Coppedge | E21B 17/01 166/363 |
| 2012/0132430 | A1 * | 5/2012 | Ebenezer | E21B 33/0355 166/340 |
| 2012/0217015 | A1 | 8/2012 | Zediker et al. | |
| 2012/0274475 | A1 | 11/2012 | Milne et al. | |
| 2014/0262309 | A1 | 9/2014 | Cain et al. | |
| 2018/0187506 | A1 | 7/2018 | Bhadbhade | |

FOREIGN PATENT DOCUMENTS

| | | | |
|---|---|---|---|
| WO | WO 2011/147882 | A1 | 12/2011 |
| WO | WO 2019/048013 | A1 | 3/2019 |

OTHER PUBLICATIONS

Danish Patent Application No. PA 2018 00076; Search Opinion dated Aug. 30, 2018, 2 pgs.

International Patent Application No. PCT/DK2019/050050, International Search Report and Written Opinion dated Jun. 11, 2019, 11 pgs.

* cited by examiner

EMERGENCY DISCONNECT SYSTEM

CROSS-REFERENCE TO RELATED APPLICATIONS

This application is a continuation of U.S. patent application Ser. No. 16/970,321, filed Aug. 14, 2020, which is a 35 U.S.C. § 371 filing of International Application No. PCT/DK2019/050050 filed Feb. 14, 2019, which claims the benefit of priority to Danish Patent Application No. PA 2018 00076 filed Feb. 14, 2018, and Danish Patent Application No. PA 2018 00202 filed May 7, 2018, each of which is incorporated herein by reference in its entirety.

FIELD

The present disclosure relates to a control system for an emergency disconnect system, an emergency disconnect system and methods of performing an emergency disconnect.

BACKGROUND

Dynamic positioning vessels capable of station-keeping, such as drill ships, semi-submersibles. FPSOs and the like are widely used in the offshore oil and gas industry. Such vessels may perform operations (e.g. drilling) that utilise riser systems that extend from the vessel to a fixed subsea location, such as a wellhead location. Examples of suitable riser systems include a marine riser that connects a subsea BOP to the vessel or a completion riser. Any undesired excursion of the vessel, which may be caused by wave, wind and current interactions, may cause undesirable stresses and strains to develop in the riser system.

Dynamic positioning involves computer based control of a vessel's position and typically includes a control system that determines the position of the vessel relative to a target position and then operates a vessel propulsion system, usually including multiple thrusters, as required, to maintain the vessel in the target position. The position of the vessel can be determined using any of a range of position determination sensors.

However, even though modern position determination sensors can be reliable and accurate, there is a risk of situations such as a blackout or other loss of power or loss of propulsion scenario that may adversely affect the positioning capability. In such situations, the vessel may drift until such time as power and propulsion can be restored. The degree and rate of drift will depend on a variety of conditions such as environmental conditions, e.g. the strength of the wind, waves, current, and/or other conditions. In such situations it can be beneficial to perform an emergency disconnection of the riser system that extends between the vessel and the fixed subsea location for example, to avoid damage to the wellhead and/or the riser system. The shallower the water (and thereby the shorter the riser system), the more critical the timeliness of such actions becomes, as less drift of the vessel can be accommodated before a critical condition, such as a critical wellhead bending moment, is reached.

SUMMARY

A first aspect of the present disclosure relates to a control system for controlling disconnection of a riser system that extends between a vessel and a subsea location that comprises a wellbore, the riser system accommodating a string, the control system being configured to disconnect the riser system according to a sequence of operations, the sequence of operations comprising disconnecting the riser system prior to or simultaneously with cutting the string and/or sealing the well bore.

The riser system may comprise a riser such as a drilling riser or a completion riser. The riser system may comprise at least one riser joint.

The subsea location may be or comprise a wellhead and/or one or more components connected to the wellhead, such as a Xmas tree. A blow-out preventer (BOP) stack may be coupled to the wellhead or coupled to the component connected to the wellhead, such as the Xmas tree. The riser system may be coupled to a lower marine riser package (LMRP), which may be comprised in the BOP stack. The BOP stack may comprise a lower BOP stack. Disconnecting the riser system may comprise disconnecting the riser from at least part of the BOP stack, e.g. from the lower BOP stack. Disconnecting the riser system may comprise disconnecting a part of the BOP stack that is coupled to the riser system, e.g. the LMRP, from another part of the BOP stack, e.g. the lower BOP stack. Once the riser system has been disconnected, the part of the BOP stack (e.g. the LMRP) may remain coupled to the riser system and the other part of the BOP stack (e.g. at least the lower BOP stack) may remain at the subsea location.

The string may be or comprise a drill string, a completion string, a landing string, a casing string, coiled tubing and/or the like.

The sequence of operation may comprise the disconnection of the riser system before or simultaneously with cutting the string and cutting the string before or simultaneously with sealing the well bore. The sequence of operation may comprise successively disconnecting the riser system, cutting the string then sealing the well bore. The initial operation of the sequence of operations may be the disconnection of the riser system.

The sequence of operations may comprise the control system sending a control command to disconnect the riser system prior to or simultaneously with sending a control command to cut the string and/or sending a control command to seal the well bore. The sequence of operations may comprise starting or completing disconnection of the riser system prior to or simultaneously with starting or completing cutting the string and/or starting or completing sealing the well bore.

The sequence of operations may comprise starting or carrying out disconnection of the riser system prior to or simultaneous with any shearing of the string or other tubing, e.g. the cutting of the string and/or the sealing of the wellbore.

The cutting of the string may comprise cutting the string using casing or shear rams (CSRs), e.g. of the blowout preventer (BOP) stack. The casing shear rams may cut the string without sealing the wellbore.

The sealing of the wellbore may comprise providing a seal between the well bore and the sea, e.g. using the lower BOP stack. If the string is solid rather than hollow cross section, then the sealing of the well bore may comprise closing at least one pipe ram around the string.

The cutting of the string may comprise using a "dead-man function" in the BOP stack. The "dead man function" may be a safety mechanism in which loss of connection to the surface causes the lower BOP stack to shear the pipe and/or string.

The sealing of the wellbore may comprise sealing the well bore using at least one blind shear ram, e.g. of the blowout preventer (BOP) stack. Where upper and lower blind shear rams are provided, the sealing of the wellbore may be performed using the upper blind shear rams (UBSRs).

The BOP stack may be configured such that the disconnection of the LMRP automatically triggers the cutting of the string, e.g. casing shear ram, and may then automatically trigger the sealing of the wellbore, e.g. using the blind shear ram(s).

Optionally, the BOP stack may be configured such that cutting of the string and/or sealing of the wellbore are triggered using an acoustic signalling device.

The control system may be further configured to close at least one annular blow-out preventer (BOP) after disconnection of the riser system. Alternatively, the annular BOP may be left open.

The control system may be configured to retract a riser of the riser system and/or the LMRP, which may comprise sending a suitable control command to another system. The riser may be tensioned by a riser tensioning system. The string may be supported by a hoisting system, which may comprise a recoil system. The riser tensioning system and the recoil system may be synchronised so that the LMRP and string move together. During the cutting of the string, the blind shear ram may hold on to an upper part of the string but once cut, the mechanical strain in the string and overpull from the rig may result in the string being pulled up. As such, the LMRP may unlatch or decouple from the lower BOP stack but may not move upwards until the string is cut. In this case, an annular of the well may optionally be closed prior to unlatching/disconnecting the riser system but alternatively may be left open.

The control system may be configured to close the annular (e.g. using the at least one annular BOP) with reduced pressure relative to a normal close pressure until both the string and LMRP are retracted. For example, the reduced pressure may be less than 75%, e.g. less than 50% of the normal close pressure. In this way the hoisting system may be able to move the string past the annulars. In a non-limiting example, the normal close pressure may be 1500 psi and the reduced pressure may be e.g. 600 psi. Preferably, an overpull of the hoisting system may be set to compensate for the resistance from the annular(s).

Retracting the string may comprise retracting a part of the string that extends into the BOP after the string has been cut. This may be achieved by setting the hoisting system to have an overpull and an anti-recoil function so that in the event that the hoisting system experiences a reduced weight it retracts in a controlled manner. This function may be implemented in a heave compensating system such as a crown compensator, a function of a draw works in a draw works based hoisting system, a function of the hoisting cylinders in a hydraulic based lifting system, and/or the like.

The latching mechanism may comprise selectively retractable and extendable pod stabs. The disconnection of the riser system may comprise retracting the pod stabs. The control system may be configured to automatically initiate cutting the string, e.g. by operating the casing shear rams, triggered by the pod stabs being retracted.

A second aspect of the present disclosure relates to a method of controlling disconnection of a riser system that extends between a vessel and a subsea location that comprises a wellbore, the riser system accommodating a string, the method comprising disconnecting the riser system prior to or simultaneously with cutting the string and/or sealing the well bore.

The method may be performed using the control system of the previous aspect.

A third aspect of the present disclosure relates to a computer program product configured such that, when implemented on a control system or processing device, causes the control system or processing device to implement the method of the preceding aspect. The computer program product may be embodied on a tangible, non-transient carrier medium.

A fourth aspect of the present disclosure relates to a system comprising at least a lower blow out preventer (BOP) stack and a controller for controlling the lower BOP stack, the lower BOP stack being configured to selectively couple with a lower marine riser package (LMRP), the lower BOP stack comprising at least at least one casing shear ram, the controller being configured to trigger, e.g. automatically trigger, the operation of the casing shear ram to cut a string in the event of the LMRP disconnecting from the lower BOP stack.

The lower BOP stack may further comprise at least one blind shear ram that is operable to seal a wellbore. The controller may be configured to trigger, e.g. automatically trigger, the blind shear ram to seal the wellbore. The triggering of the blind shear ram may be simultaneously with or after triggering the casing shear ram.

The controller may be an electrical controller or a hydraulic controller.

The system may comprise the LMRP. The system may be, comprise or be comprised in a blow out preventer (BOP).

The system may be operable with and/or responsive to the control system of the first aspect.

A fifth aspect of the present disclosure relates to a method of operating a lower blow out preventer (BOP) stack that is configured to selectively couple with a lower marine riser package (LMRP) and the lower BOP stack comprising at least at least one casing shear ram. The method may comprising triggering, e.g. automatically triggering, the operation of the casing shear ram to cut a string in the event of the LMRP disconnecting from the lower BOP stack.

The lower BOP stack may further comprise at least one blind shear ram that is operable to seal a wellbore. The method may comprise triggering, e.g. automatically triggering, the blind shear ram to seal the wellbore. The method may comprise triggering the blind shear ram simultaneously with or after triggering the casing shear rain.

A sixth aspect of the present disclosure relates to a control system for controlling disconnection of a riser system that extends between a vessel and a subsea location, the control system being configured to determine a position of the vessel and/or occurrence of a control enabling event, such as a blackout or other power failure event of the vessel, the control system being configured to determine if a disconnect condition has been met based on the determined position of the vessel and/or the determination of the occurrence of the control enabling event (e.g. blackout or power failure), the meeting of the disconnect condition indicating that the riser system should be disconnected.

The control system may be operable to selectively or only control the disconnection of the riser system if occurrence of the control enabling event has been or is being detected. The control system may be configured to disable, abort and/or render dormant the control of the disconnection of the riser system if it determines that the control enabling event no longer applies, e.g. if the power is reinstated to the vessel.

The control system may be configured to automatically disconnect the riser system, e.g. by initiating an emergency disconnection scheme for disconnecting the riser system, responsive to the disconnect condition being met. The emergency disconnection scheme may optionally comprise the method of the second aspect. The control system may be configured to provide an alert to an operator if the disconnect condition is met.

The control system may be configured to determine the position of the vessel relative to a reference position. The reference position may be a target position or a position of the vessel upon a blackout or other vessel condition potentially requiring emergency disconnect. The reference position may be a position directly above the subsea location.

The control system may be configured to monitor or receive the position of the vessel, e.g. over time. The control system may be configured to monitor or receive a rate, rate of change and/or direction of movement, e.g. a rate, rate of change and/or direction of drift, of the vessel, which may be based on the change in position of the vessel. The position of the vessel and/or the rate, rate of change and/or direction of movement may be relative to the reference position.

The control system may be configured to determine a disconnection threshold. The disconnection threshold may be or comprise a deviation from the reference position that is less than or equal to a deviation from the reference position beyond which the riser system or a component connected to the wellhead would reach a critical condition before the riser system could be disconnected if the vessel continues to move or drift at its current or a predicted rate, rate of change and/or direction.

The control system may be configured to determine the disconnection threshold at least partly based or dependent on a currently selected emergency disconnection scheme. For example, the control system may be configured or selectively configurable into one or more emergency disconnection schemes. Each emergency disconnection scheme may be associated with a corresponding time to disconnect the riser system. The disconnection threshold may be dependent on the time it takes to disconnect the riser system using the current emergency disconnection scheme. For example, if the current emergency disconnection scheme has a relatively short delay between initiation of the emergency disconnection scheme and disconnection of the riser system (e.g. as is the case for the sequence implemented by the control system of the first aspect and method of the second aspect) then more time to reinstate power to the vessel may be taken before initiating the emergency disconnection scheme the disconnection threshold may be made larger). Conversely, those emergency disconnection schemes that have a relatively long delay between initiation of the emergency disconnection scheme and disconnection of the riser system may allow less time for reinstating power to the vessel before the emergency disconnection scheme should be initiated (i.e. the disconnection threshold may be made smaller).

The control system may be configured to determine the disconnect condition by determining the position of the vessel or the deviation of the vessel from the reference position relative to the disconnection threshold, e.g. if the vessel is within an operating margin of, meets or exceeds the disconnection threshold.

The riser system may be or comprise a riser, such as a drilling riser, completion riser, production riser and/or the like. The vessel may be or comprise a dynamic positioning vessel capable of station-keeping. The vessel may be or comprise a drill rig, drill ship, semi-submersible, FPSO or the like. The subsea location may be, comprise and/or be associated with a wellhead. The disconnection of the riser system may comprise disconnecting the riser system subsea, e.g. at or proximate the subsea location and at or towards an end of the infra-structure that is at towards the subsea location and away or distal from the vessel in use. The disconnection of the riser system may comprise disconnecting the riser system at a lower marine riser package (LMRP) or at a completion riser unlatch mechanism.

In this way, the control system may monitor or receive the position of the vessel and determine if the time it will take to drift or move to a position where the critical condition would be reached (i.e. the operation would be in a risk state) is at or greater than the time it will take to disconnect the riser using a currently selected emergency disconnection scheme, such as (but not limited to) that described above in relation to the first and second aspects. The risk state may be (but may not be limited to) at least one of: the riser system being in a critical condition, such as at or beyond a critical bend or angle (optionally with an additional margin of error), the riser is unable to be disconnected, being unable to seal the wellbore, there being a risk of damage to the vessel, riser, LMRP, lower BOP stack, wellhead, or well, and/or a risk of damage being caused by the disconnection, e.g. making it difficult to reconnect or jeopardising a well seal. The control system may delay the operation of the emergency disconnection scheme until it determines that the time it takes to drift or move to a position where the operations would be in the risk state is within an operational margin of the time it will take to disconnect the riser using a current emergency disconnection scheme, in which case it will then initiate (e.g. automatically initiate) the current emergency disconnection scheme. If the control enabling event can be remedied (e.g. the power restored) before the vessel has drifted to a location in which the emergency disconnection scheme would need to be initiated for it to disconnect the riser system before the critical condition or risk state is reached, the emergency disconnection may be aborted. In this way, the emergency disconnection of the riser is performed if and when needed but not before. If the time between initiation of the emergency disconnection scheme and disconnection of the riser system can also be reduced, e.g. using the emergency disconnection scheme described above in relation to the first and second aspects, then the time available to restore power before having to initiate the emergency disconnection scheme provided using the drift monitoring described above can be further increased.

Furthermore, the delay may, in some circumstances, provide enough time for secondary or lower blind shear rams to be closed in addition to the upper blind shear rams, e.g. by an ROY or other mechanism. As the string could be cut (e.g. using the casing shear rains) before the wellbore is sealed by operating the upper blind shear rams, there is a risk that some casing or other structure could remain across the upper blind shear rams, which may result in the effectiveness of the seal provided by the upper blind shear rams being reduced. The extra time available resulting from the above drift monitoring automatic emergency disconnection procedure in conjunction with the provision of an emergency disconnection scheme that has minimal or no delay between initiating the scheme and disconnection of the riser system (such as that described in relation to the first and second aspects) may also allow the time for the lower blind shear rams to be closed and thereby the wellbore being more reliably secured.

The control system may be configured to automatically and/or dynamically determine the position of the vessel, automatically and/or dynamically determine the disconnect condition based on the determined position of the vessel and automatically and/or dynamically implement the current emergency disconnection scheme when the disconnect condition has been met.

The control system may be configured to determine one or more properties of the riser system and at least partly determine if a disconnect condition has been met based on the one or more properties of the riser system. The one or more properties of the riser system may be or comprise an angle, orientation, bending, inclination, flex, stress or strain of at least part or all of the riser. The control system may be configured to determine if the disconnect condition has been met when the one or more properties of the riser system meet one or more criteria. The one or more criteria may comprise the property of the riser being at or above an associated threshold or within an operational range.

The controller may be in communication with one or more location sensors for determining the position of the vessel. At least one of the location sensors used to determine the position of the vessel may comprise at least one satellite positioning system sensor, e.g. at least one GPS, GLONASS or Galileo sensor, configured to determine the position of the vessel using satellite positioning. The location sensors may comprise at least two different types of satellite positioning sensor.

At least one of the location sensors used to determine the position of the vessel may comprise at least one motion sensor such as a gyroscope or accelerometer for monitoring motions, e.g. movement, translation or reorientation, of the vessel. At least one of the location sensors may comprise a beam sensor configured to transmit a beam to and/or receive a beam from a reference point. The beam may comprise a microwave, radiofrequency, sonic or ultrasonic, sonar, optical, visible light, infra-red or ultra-violet, laser, cellular communications, or other radiation beam.

The control system may be configured to receive data representative of environmental, sea or weather conditions at or around the vessel, e.g. from one or more further sensors or from a database or other information service. The control system may be configured to use the data representative of environmental, sea or weather conditions at or around the vessel to at least partly determine or predict the rate, rate of change and/or direction of movement, e.g. a rate, rate of change and/or direction of movement or drift, of the vessel. At least one or each of the further sensors may be provided on the vessel. At least one of the further sensors used to determine the position of the vessel may comprise at least one weather sensor, such as a wind sensor for monitoring the speed, strength and/or direction of the wind at or around the vessel.

The location sensors and further sensors need not be limited to the examples given above. The control system may be configured to use the signals from each of the location sensors and further sensors individually and/or combinations of different types of sensor to determine the position of the vessel and/or the rate, rate of change and/or direction of movement or drift of the vessel. For example, at least one of the further sensors may comprise a sea sensor configured to determine water speed, tide direction and/or strength, wave height, wave frequency and/or the like. However, the sensor data available may depend on those already installed in an existing dynamic positioning system when retrofitted into an existing system.

The reference position may be a pre-set position or a manually set position and may be stored in a memory of the control system.

The control system may comprise at least one processor. The control system may comprise and/or be configured to access at least one data store or memory. The control system may comprise a communications system, such as a wired and/or wireless communications system. The control system may be configured to communicate with a control system of the vessel, the at least one location sensor and/or the at least one further sensor, e.g. via wired and/or wireless communication. The control system may be a distributed control system, e.g. the control system may comprise one or more controllers that control operation of equipment such as a controller for the BOP. The control system may be implemented by suitably reconfiguring existing controllers or by a stand alone controller that communicates with A fifth aspect of the present disclosure relates to a method of controlling disconnection of a riser system that is supported by a vessel, the method comprising: determining a position of the vessel and/or determining a control enabling event, such as a blackout or other power failure event of the vessel; and determining if a disconnect condition has been met based on the determined position of the vessel and/or the determination of the control enabling event (e.g. blackout or power failure), the meeting of the disconnect condition indicating that the riser system should be disconnected.

The method may be performed using the control system and/or the system of the previous aspects.

A sixth aspect of the present disclosure relates to a computer program product configured such that, when implemented on a control system or processing device causes the control system or processing device to implement the method of the preceding aspect. The computer program product may be embodied on a tangible, non-transient carrier medium.

The individual features and/or combinations of features defined above in accordance with any aspect of the present invention or below in relation to any specific embodiment of the invention may be utilised, either separately and individually, alone or in combination with any other defined feature, in any other aspect or embodiment of the invention.

Furthermore, the present invention is intended to cover apparatus configured to perform any feature described herein in relation to a method and/or a method of using or producing, using or manufacturing any apparatus feature described herein. For any of the apparatus features described above as performing a function, the present invention also covers a method comprising performing that function.

BRIEF DESCRIPTION OF THE DRAWINGS

These and other aspects of the present disclosure will now be described, by way of example only, with reference to the accompanying Figures, in which.

DETAILED DESCRIPTION OF THE DRAWINGS

Various aspects and examples of the present disclosure relate to methods, systems and apparatus for the dynamic position control of offshore vessels. Any vessel may be considered, but for the purposes of the exemplary description provided below, a semi-submersible drilling vessel or "rig" is presented.

Figure 1:
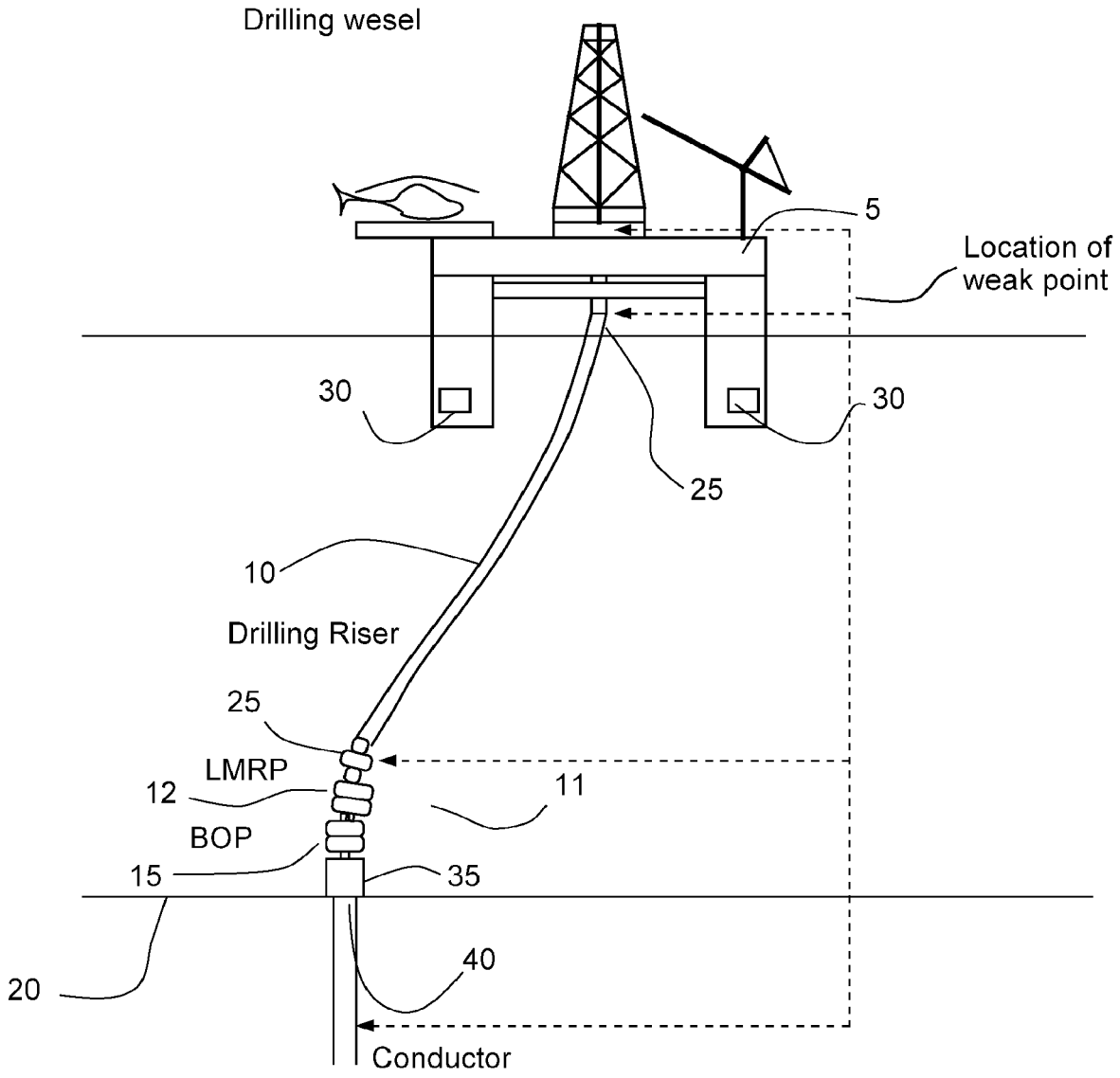
FIG. 1 is a schematic of a drilling arrangement.

FIG. 1 shows a semi-submersible 5 that is connected to, and supports one end of, a riser system comprising a riser 10, such as a drilling riser. The riser 10 extends from the vessel 5, underwater to connect to a blow-out preventer (BOP) stack 11 comprising a lower marine riser package (LMRP) 12 and a lower blow-out preventer (BOP) stack 15 at a fixed subsea location on the sea bed 20. The lower marine riser package (LMRP) 12 is coupled to the riser and is connected in a selectively releasable manner to the blow out preventer (BOP) stack 15. The riser 10 is optionally provided with a pair of flex joints 25, one at the surface end and one at the subsea end. The vessel 5 can be moved, e.g. due to currents, waves and wind, and is maintained in a target position using a dynamic positioning system, as is well known in the art. The vessel comprises a propulsion system that comprises a plurality of propulsion devices such as thrusters 30. The thrusters 30 are configured to propel the vessel 5 in different directions and are selectively controllable to adjust the position of the vessel 5.

The vessel shown in FIG. 1 is a drilling rig, but it will be appreciated that the vessel is not limited to this and can equally be a ship, or indeed any other suitable vessel or vehicle, such as a drilling vessel that can perform drilling of all sections of the well. Furthermore, although the riser 10 is connected at the subsea end to a lower marine riser package 12 which is in turn releasably connected to the lower BOP stack 15, it will be appreciated that the riser could be connected to any other suitable wellhead apparatus, such as a Xmas tree, e.g. via the BOP stack 11. In addition, although an example comprising a drilling riser is shown, it will be appreciated that the present concept could be used for other functions such as completion, in which case the riser 10 would be a completion riser.

The dynamic positioning system of the vessel 5 is configured to determine the position of the vessel 5, compare the determined position of the vessel 5 with a target position and determine corrective control actions for specific thrusters 30 to, as far as possible, maintain the vessel 5 substantially in the target position. However, there may be situations, such as a blackout or loss of power by the vessel 5, where it could be desirable to perform an emergency disconnect of the riser 10. For example, since the riser 10 is suspended between the vessel 5 and a fixed subsea position 12, 15, if the vessel moved too far off the target location, then damage to the riser 10 and/or the subsea components 11, 12, 15 could occur, e.g. due to bending of the riser 10 past a critical angle.

The time available to disconnect the riser 10 in an emergency situation can vary. Operations in shallow water provide much less time to act, as the shallower the water the less the distance that the vessel 5 can move off station before the riser 10 is bent to its critical angle. As such, having an emergency disconnection scheme that allows a quick disconnect can be highly advantageous, particularly for shallow water operations. Emergency disconnection of the riser 10 can comprise several steps and the choice of steps and the sequence in which they are implemented can have a significant effect on the time taken for the riser 10 to be disconnected.

Figure 2:
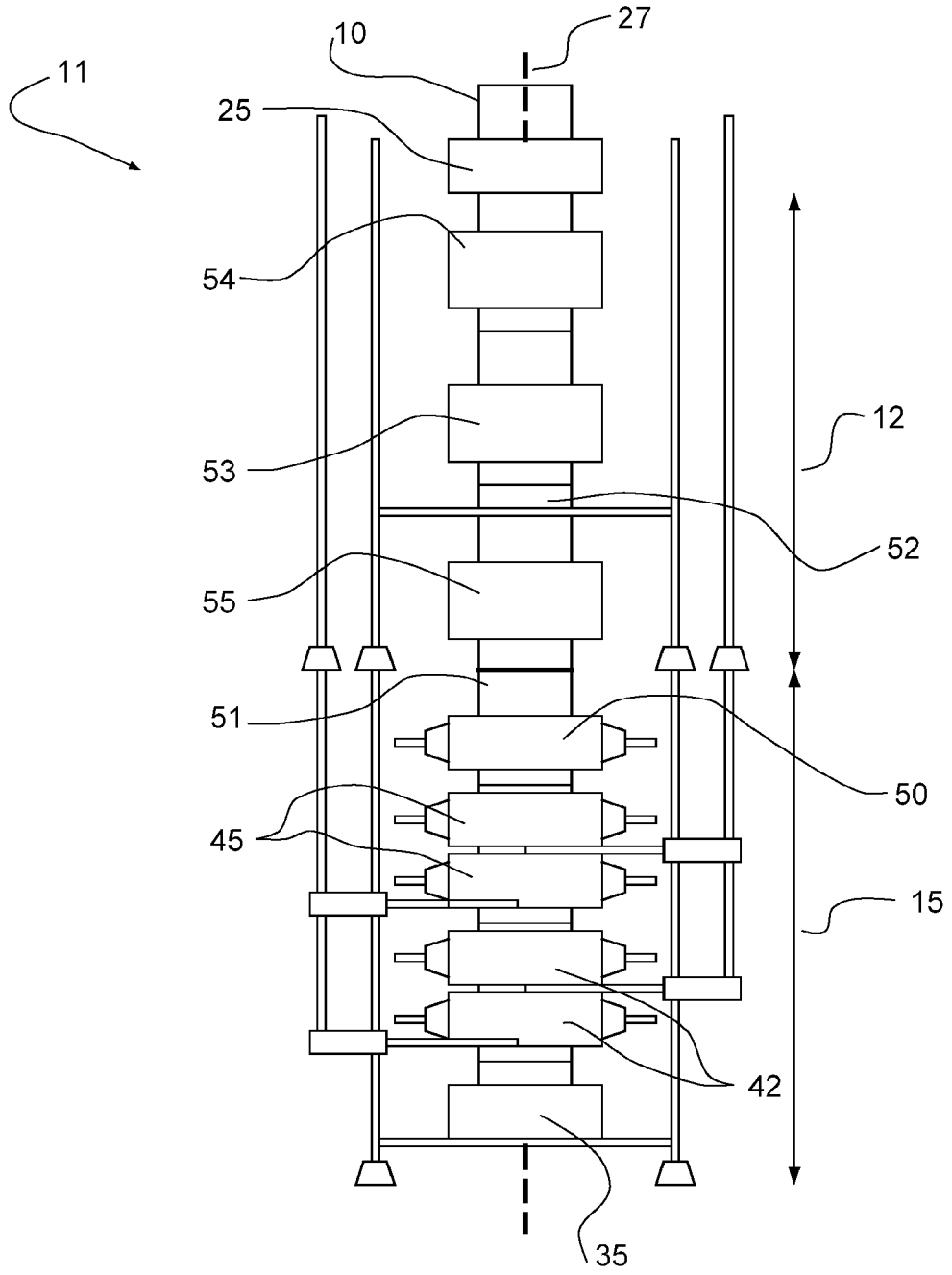
FIG. 2 is a schematic of a blowout preventer and lower marine package for use in the drilling arrangement of FIG. 1.

FIG. 2 shows an example of the BOP stack 11, comprising the lower marine riser package 12 and the lower BOP stack 15, shown in FIG. 1. A string 27 (e.g. a drill string) runs through the lower marine riser package (LMRP) 12 and lower BOP stack 15. The drill string 27 supports the drill bit (not shown) and serves to convey drilling fluid from the surface to the drill bit, as is well known in the art. The lower BOP stack 15 comprises a wellhead connector 35 for connecting to the wellhead 40, pipe rams 42 for sealing around a drill pipe, casing shear rams 45 for cutting the string 27 without sealing, blind shear rams 50 for sealing the wellbore and an upper connector 51 for connecting to the LMRP 12, the upper connector 51 being distal to the wellhead connector 35. The LMRP 12 comprises a lower connector 52, and lower and upper annular BOPs 53, 54. The LMRP 12 is coupled at an end distal to the lower BOP stack 15 to the lower flex joint 25 for connecting to the riser 10. It will be appreciated that the BOP stack 11 would typically comprise a number of other well-known components such as variable bore rams (VBRs) and the hydraulic systems and valves required to operate the various rams but that these are not shown only for clarity and simplicity. Similarly, it will also be appreciated that the BOP stack 11 could come in a range of forms and comprise one or more of each ram type and the present disclosure is not limited to the BOP stack 11 shown. For example, the BOP stack could alternatively be, or comprise one or more features of, a BOP stack described in US2012/0197527, which is hereby incorporated by reference in its entirety as if set out in full herein.

The lower marine riser package 12 is releasably coupled to the lower BOP 15 stack such that it can be selectively released to decouple the lower marine riser package 12 and the riser 10 from the lower BOP stack 15 to thereby disconnect the riser 10 from the fixed subsea location. When disconnected, the LMRP 12 remains coupled to the riser 10 and is free to move away from the lower BOP stack 15, which remains fixed at the wellhead (optionally via a Xmas tree).

One emergency disconnection scheme for releasing the riser 10 would be to initially cut the string 27 using the casing shear rams 45, then subsequently seal the wellbore with the blind shear rams 50 before disconnecting the riser 10 by switching the connector 55 of the lower marine riser package 12 into the released configuration. This sequence provides good wellbore sealing and minimises loss from the wellbore but takes a relatively long time before the riser 10 is disconnected. In one example, implementation of this sequence resulted in a 76 second delay between the sequence being initiated and the riser being released. However, it will be appreciated that the actual time to disconnect may vary in different systems.

Another emergency disconnection scheme would be to cut the string 27 using the casing sheer rams 45, then disconnecting the riser 10 using the connector 55 of the lower marine riser package 12 before sealing the wellbore with the blind shear rams 50. This emergency disconnection scheme has a much shorter delay between initiation of the emergency disconnection scheme and the release of the riser 10, with an example under equivalent conditions to the example given above resulting in a delay in the region of 39 to 44 seconds between the sequence being initiated and the riser being released. However, it will be again appreciated that the actual time to disconnect may vary in different systems.

If approximately 30 seconds is added to these delays in disconnecting the riser to account for human reaction and thinking time in a manually operated system, then there is a real risk that, for shallow water operations, these emergency release sequences won't result in release of the riser 10 before damage to the riser 10 or other components occurs.

Figure 3:
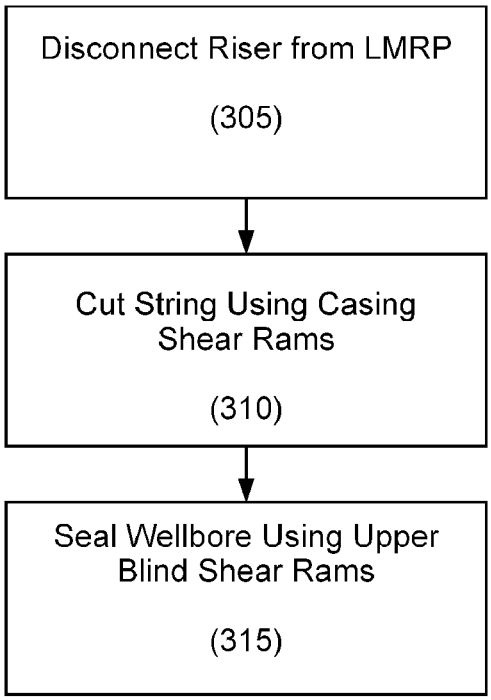
FIG. 3 is a flowchart illustrating method steps of an emergency disconnection scheme.

In such cases, a particularly beneficial emergency disconnection scheme, as shown in FIG. 3, comprises, in step 305, initially disconnecting the riser 10 using the connector 55 of the lower marine riser package 12 before, in step 310, then cutting the string 27 using the casing sheer rams 45 and subsequently, in step 315, sealing the wellbore with the blind shear rams 50. In this case, in an equivalent example to those given above, the delay between the emergency disconnection scheme being started and the release of the riser 10 was found to be in the order of 25 to 29 seconds. In situations where every second could potentially count, such as during shallow water operations, this faster emergency disconnection scheme could make the difference between the riser 10 being successfully released or damaged.

Figure 4:
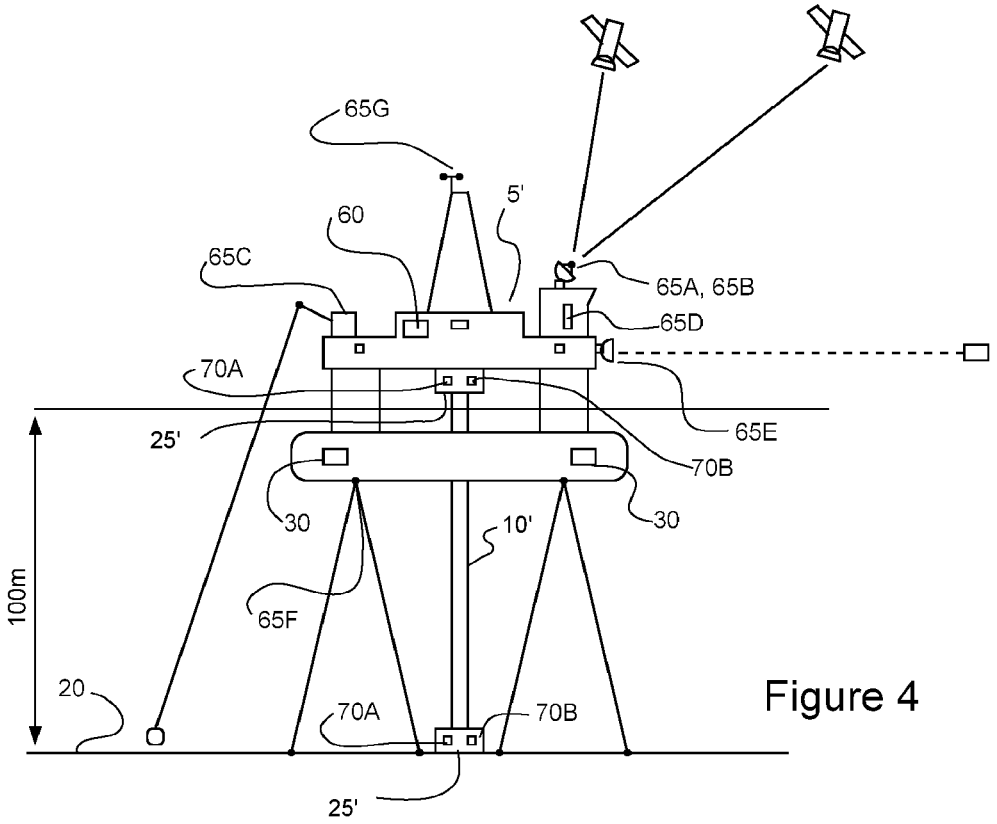
FIG. 4 is a schematic of an example of a drilling arrangement involving a drilling vessel.
Figure 5:
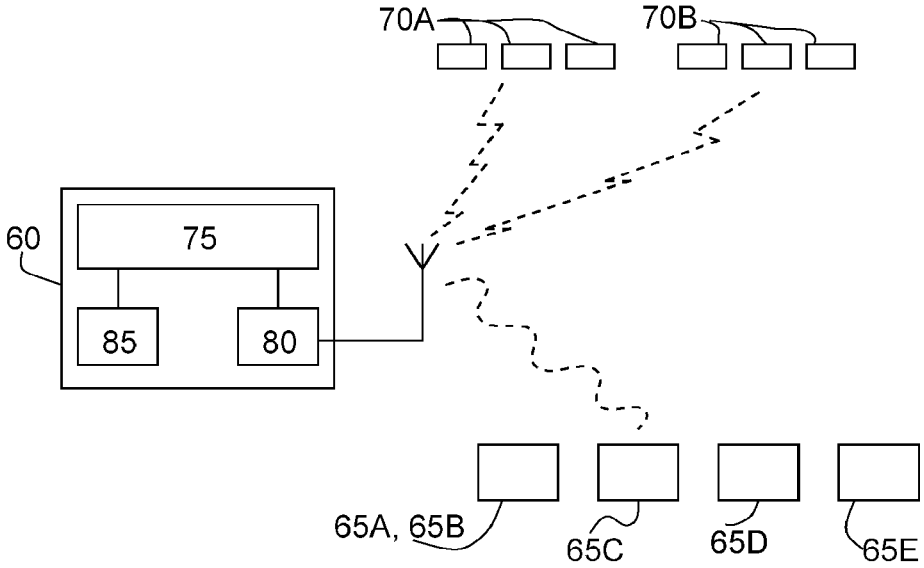
FIG. 5 is a schematic of a control system for controlling disconnection or riser system supported by a drilling vessel, such as those shown in FIG. 1 or FIG. 4.

The emergency disconnection schemes described above are implemented by a suitable control system 60 (see FIGS. 4 and 5). This could be part of an existing control system or a dedicated stand-alone system. Regardless, it may be possible to retrofit the emergency disconnection schemes in existing vessels by suitably reprogramming an existing control system or by installing the stand-alone system.

The control system 60 could be configured to simply implement a single, preprogrammed emergency disconnection scheme, which could be any of those described above, or the control system could be configured such that it is possible to switch between emergency disconnection schemes, e.g. by manual selection, to suit the particular operation being performed.

Beneficially, the electronic control system 60 is configured to automatically initiate the emergency disconnection scheme. As indicated above, when the emergency disconnection scheme is manually initiated, a further delay of around 30 s must be factored in for human intervention "thinking time". This further delay can be significantly reduced by having the control system 60 dynamically monitor the vessel 5 in use and automatically initiate the emergency disconnection scheme.

Examples of a vessel and control system for implementing this are shown in FIGS. 4 and 5.

FIG. 4 shows a vessel 5' provided with a dynamic positioning system that comprises a control system in the form of an emergency disconnection system (EDS) controller 60 that is in communication with a plurality of location sensors 65A-65G used for determining the location of the vessel 5' and a plurality of riser sensors 70A, 70B used for monitoring properties of the riser 10'. The controller 60 is configured to provide dynamic and automatic control of emergency disconnection of the riser 10' based on the location of the vessel 5' determined using the position sensors 65A-G and/or the properties of the riser 10' determined using the riser sensors 70A, 70B and is also operative only whilst a blackout or other loss of power or positioning ability is detected.

As in the example of FIG. 1 the vessel 5' supports an end of a riser 10' that extends between the vessel 5' and a wellhead 40 on the seabed 20. The wellhead 40 is coupled to the BOP stack 11 that comprises the lower marine riser package 12 and the BOP stack 15 as shown in FIGS. 1 and 2.

A detailed schematic of the controller 60 is shown in FIG. 5. The controller 60 comprises a processor 75, a communications system 80 and a data store in the form of a memory 85. The communications system 80 is configured to communicate via wires or wirelessly with a plurality of location sensors 65A-65G used for position determination and a plurality of riser sensors 70A, 70B to receive data signals therefrom. The wireless communications could comprise acoustic communications, e.g. along the riser 10. In this way, the controller 60 can receive data from the plurality of location sensors 65A-65G, which is processed by the controller 60 to determine the position of the vessel 5, 5'.

Although an example of a controller 60 is shown in FIG. 5, it will be appreciated that other controller configurations could be used. For example, the controller 60 may comprise a plurality of processors 75 and/or a plurality of data stores 85, which may be contained in a single unit or distributed, e.g. over several systems, some of which may be remote.

Figure 6:
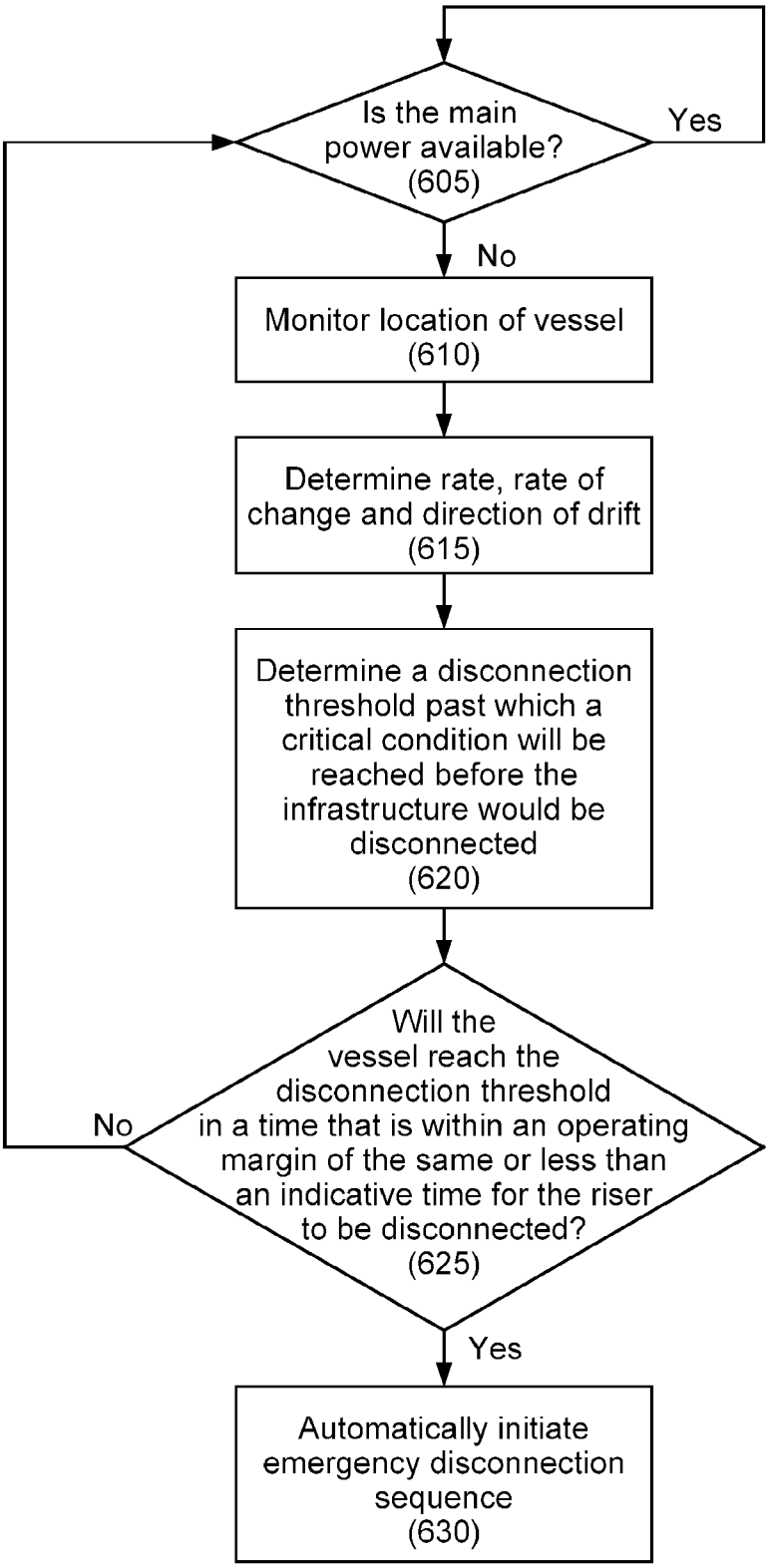
FIG. 6 is a flowchart illustrating a method of controlling disconnection of riser system supported by a vessel, such as those shown in FIG. 1 or 4.

The actions performed by the controller 60 are described in relation to FIG. 6.

In the present embodiment, the goal of the automatic emergency disconnect monitoring procedure is to automatically disconnect the riser optionally 10 before the riser 10 or another component such as the BOP stack 11, Xmas tree or wellhead reaches a critical condition in which it could be damaged. One example of a critical condition could be when the riser 10 reaches a predetermined critical bend angle, e.g. 6°, However, the automatic emergency disconnect monitoring procedure is also configured such that, if possible without risking damage to the riser 10, time is allowed for power to be restored in order to avoid unnecessary disconnecting of the riser 10. Within this procedure, reducing the time between initiation of an emergency disconnection scheme that disconnects the riser 10' and the LMRP 12 from the lower BOP stack 15 and the actual disconnection of the riser 10' and LMRP 12 (e.g. by using the method of FIG. 3), allows more time in which the power can be restored, increasing the likelihood of unnecessarily disconnecting the riser 10'.

In step 605 of FIG. 6, the controller 60 determines if the main power is available on the vessel 5, 5'. If the power is available, an automatic emergency disconnect monitoring procedure lies dormant and no automatic emergency disconnection of the riser 10, 10' takes place. The controller 60 then continues to check the main power of the vessel until it detects that the main power is not available. If the controller 60 determines that the main power of the vessel 5, 5' has been lost, then it implements the automatic emergency disconnect monitoring procedure. Although a detection of the main power is described above, detection of other power loss or loss of positioning conditions could be additionally or alternatively performed.

In step 610, the controller 60 monitors the location of the vessel 5, 5' via the location sensors 65A-65G and in step 615 determines the degree, rate, rate of change and direction of drift of the vessel 5, 5' from its target location and/or from the location of the vessel before the loss of power.

In step 620, the controller 60 determines a disconnection threshold that specifies how far the vessel 5, 5' can drift from its target location (e.g. above the wellbore/subsea location, or its location when the power failed), before the critical condition is reached (e.g. an operating margin before the lower flex joint 25 or other component would reach its critical bend angle). For example, the controller 60 could be provided with a determined or predetermined disconnection threshold or the controller could determine the disconnection threshold based on parameters such as the depth of the sea at the current location, the length of the riser 10, the amount of flex in the flex joint(s) 25 and so on, e.g. using geometry, an algorithm or modelling.

Each emergency disconnection scheme is associated with an indicative time for the riser to be disconnected using that emergency disconnection scheme (which may also include an additional operating margin or represent a "worse case" scenario). The controller 60, in step 625, determines if the vessel 5, 5' drifting at the determined or predicted rate of drift, in the determined drift direction, from the determined location would reach the disconnection threshold in a time that is with an operation margin of, the same or less than the indicative time for the riser to be disconnected and if so initiates the disconnection of the riser 10 using the emergency disconnection scheme (e.g. the emergency disconnection scheme shown in FIG. 3, or any of the other emergency disconnection schemes described above, amongst other possibilities).

If the controller 60 instead determines that the vessel 5, 5' drifting at the determined or predicted rate of drift, in the determined drift direction, from the determined location would not reach the disconnection threshold in the indicative time for the riser to be disconnected, it instead reverts the process back to step 605 and re-checks if the main power is available on the vessel 5, 5'. In this way, if the main power is restored before the emergency disconnect scheme is initiated, then the automatic emergency disconnect procedure is effectively aborted and returned to the dormant state until the controller 60 once again determines that the main power is lost.

In this way, the controller 60 is configured to automatically initiate the emergency disconnect scheme to disconnect the riser if the main power of the vessel is lost (i.e. blackout) shortly before the vessel 5' reaches the point that it would drift far enough for the critical condition to be reached (e.g. the riser 10 being bent past its critical angle) before the riser 10 could be disconnected using the current emergency disconnection scheme. In this way, if the riser 10 needs to be disconnected quickly (e.g. if the vessel is in shallow water operations or if the sea or weather state is such that the vessel 5, 5' will drift off station quickly) then the controller 60 would act quickly to automatically initiate the emergency disconnect scheme. However, in more benign conditions, e.g. in summer when the weather and sea state is favourable or if the water depth is greater, then the initiation of the emergency disconnect scheme can be delayed until shortly before the drift of the vessel would result in the critical condition being reached before the riser could be disconnected. In this way, the controller 60 provides a chance for the vessel power to be restored, thereby potentially avoiding an unnecessary riser 10 disconnection.

It will be appreciated that alternatives to the above method are possible.

Although the example described above describes an automatic emergency disconnect monitoring procedure that seeks to automatically disconnect the riser 10 before the critical condition is reached, where the critical condition comprises the riser 10 reaching a predetermined critical bend angle, the present disclosure is not limited to this. For example, in an embodiment, the automatic emergency disconnect monitoring procedure could comprise automatically initiating the emergency disconnection sequence immediately upon loss of power blackout, or after a determined or predetermined period of time with loss of power/blackout.

In another embodiment, the automatic emergency disconnect monitoring procedure could comprise initiating only a subset of steps in the emergency disconnect sequence immediately upon loss of power/blackout or after a determined or predetermined amount of time of loss of power/blackout and then initiating the remainder of the steps of the emergency disconnect sequence once the critical threshold is reached or approached or after a further determined or predetermined period of time. For example, the predetermined amount of time could be the time a black-out recovery should normally take, such as 5 minutes or less, such as 2 min or less, such as 1 min or less, e.g. 30 s or less or 20 s or less. The controller 60 is optionally configured to initiate or bring forward the remainder of the steps of the emergency disconnect sequence if there is a failure to complete any of the subset of steps in the emergency disconnect sequence. The subset of steps could include, for example, steps that do not include physically disconnecting the riser and/or which are easily reverted, such as closing various valves, closing annular BOPs etc. The remainder of the steps may comprise steps that involve disconnecting the riser and shearing, e.g. shearing the string, sealing the wellbore, sealing the string, and/or the like.

It will also be appreciated that other critical conditions could be used and that the critical condition need not be a condition of the riser but could be a critical condition of the wellhead, BOP stack, Xmas tree or other component. For example, the critical condition could be a critical wellhead bending moment.

For example, the above method determines if the current drift of the vessel would result in it reaching the critical condition (e.g. where the riser 10 is bent to or beyond its critical angle, including the operational margin) only using the determined location of the vessel 5, 5'. However, it will be appreciated that other metrics for determining whether or not the drift would result in the critical condition (e.g. the bending of the riser to or beyond its critical angle) could be used instead of, or in addition to, the determined location of the vessel 5, 5'.

For example, riser sensors 70A, 70B, optionally located at the flex joints 25, could be used to directly measure the bend angle and/or the rate of change of bend angle of at least part of the riser 10, 10', which could be used instead of or in addition to the location/drift of the vessel 5, 5'. Strain, stress or other properties of the riser, flex joint or any other critical component could also be used. Furthermore, additional data, such as tide data, sea state data and/or weather forecast or measurement data could be used to increase the accuracy of the determination.

The controller 60 can determine the location of the vessel 5 from data from the plurality of sensors 65A-65G used for position determination, which could include a variety of different sensor types. In this particular example, the sensors 65A-65G used for position determination include at least two satellite navigation sensors 65A, 65B provided on the vessel 5, a wire sensor 65C on the vessel 5 that determines a tension or force on a taut wire that is suspended between the vessel 5 and a fixed external point, e.g. on the sea bed and a plurality of motion sensors 65D, in this example in the form of four gyroscopic sensors, which are configured to measure motion of the vessel. The sensors 65A-65G used for position determination in this example further include a plurality of beam position sensors 65E, 65F, including a surface based beam sensor 65E that sends a beam to and/or receives a beam from a reference point, e.g. on land or on another vessel or other sea structure. Similarly, the vessel 5 could comprise a plurality of underwater beam sensors 65F, such as sonar or other sonic sensors, that are each in communication with a plurality of reference points located on the sea bed using sonic or sonar signals and can be used to determine changes in the location of the vessel 5 using the relative timing and/or strength of the sonic or sonar signal received from each reference point. The sensors used for position determination in this example further include condition sensors 65G, which include weather sensors such as wind sensors, and also include water current sensors to determine current direction and speed of water currents.

The controller 60 is in communication with all of the sensors 65A-65G used for position determination and uses the data collected by the sensors 65A-65G used for position determination to determine a position of the vessel 5, e.g. according to a predetermined algorithm or other suitable relation. However, it will be appreciated that the above are just examples, and only one or more or any combination of the above location sensors, or indeed entirely different location sensors could be used.

In an optional example, each end of the riser 10' is provided with a flex joint 25' and each flex joint is provided with at least three of the sensors 70A, 70B that monitor at least one property of the flex joint 25' that changes when the vessel 5' is moved. Suitable properties of the flex joint include tilt, inclination, angle, orientation, flex, bend, stress or strain, or other suitable property of the respective flex joint 25' or other part of the riser 10'. The sensors 70A, 70B need not be located only at the flex joint 25' and one or more sensors may be provided on or along the riser 10', in addition to or as an alternative to the sensors 70A, 70B at the flex joints 25'. The controller 60 can optionally be configured to at least partially determine if the emergency disconnection procedure should be initiated at least partly based on the determined values of the at least one property of the riser 10'.

Although, specific examples are described above in relation to the Figures, it will be appreciated that variations on the above examples are possible.

For example, although a drilling riser 10 and drilling arrangement are described above, the same concepts could also be applied to completion and production arrangements e.g. using completion or production risers. Indeed, the present disclosure could also be used in relation to other objects, lines or general infrastructure that extends between a vessel and a subsea location.

Furthermore, although certain specific examples of sensors 65A-65G used for position determination are given above, it will be appreciated that different sensors or combinations of sensors could be used instead.

In addition, the vessel 5 need not be a drilling rig and other vessels such as ships could be used instead. For example, the vessel 5 could be a drill-ship, semi-submersible or other floating drilling unit. The vessel could be any suitable vessel that can drill and utilizes dynamic positioning and is preferably not moored. In the event of a completion/work-over riser, the vessel could also be a drilling work-over platform.

Although examples are given above where the riser system 10 is disconnected by disconnecting the LMRP 12 that is coupled to the riser 10 from the lower BOP stack 15, the present disclosure is not limited to this. The disconnection of the riser system 10 may, comprise other means for disconnecting the riser system 10 subsea, e.g. at or proximate the subsea location and at or towards an end of the infra-structure that is at towards the subsea location and away or distal from the vessel, in use. The disconnection of the riser system 10 may comprise disconnecting the riser system 10 from the subsea location such that it remains supported by the vessel. The control system may be configured to directly or indirectly control a latching mechanism located at or proximate the subsea location, e.g. comprised in the lower marine riser package (LMRP) or a completion riser unlatch mechanism. The latching mechanism may be selectively switchable between a latched configuration in which the riser system is latched and secured at the subsea and an unlatched configuration in which the riser system is disconnected from the subsea location. The control system may be configured to disconnect the riser system by switching the latching mechanism into the unlatched configuration, e.g. from the latched configuration.

Although one possible example of control system 60 is descried in relation to FIG. 5, the control system 60 configuration is not limited to this. Method steps of the invention can be performed by one or more programmable processors of the control system 60 executing a computer program to perform functions of the invention by operating on input data and generating output. Method steps can also be performed by special purpose logic circuitry, e.g., an FPGA (field programmable gate army) or an ASIC (application-specific integrated circuit) or other customised circuitry of the control system 60. Processors suitable for the execution of a computer program include CPUs and microprocessors, and any one or more processors. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data e.g., magnetic, magneto-optical disks, or optical disks. Information carriers suitable for embodying computer program instructions and data include all forms of non-volatile memory, including by way of example semiconductor memory devices, e.g. EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

As such, the present invention is not limited by the examples shown in the drawings but only by the claims.

I claim:

1. A control system for controlling disconnection of a riser system that extends between a vessel and a subsea location that comprises a wellbore, wherein the control system is configured to, when a loss of a power source is detected, enter an emergency disconnect monitoring procedure in which a predetermined parameter of the riser system is monitored, the predetermined parameter has a critical condition; and wherein the control system, in the emergency disconnect monitoring procedure, is configured to:

determine a position of the vessel, determine drift of the vessel, determine a value of the predetermined parameter, determine whether a disconnect condition has been met based on the determined position of the vessel, the drift of the vessel, and the value of the predetermined parameter of the riser system, and disconnect the riser system when the disconnect condition has been met.

2. The control system according to claim 1, wherein the control system, in the emergency disconnect monitoring procedure, is configured to detect whether the power source is still lost, and to discontinue the emergency disconnect monitoring procedure when a loss of the power source is no longer detected.

3. The control system according to claim 2, wherein the control system, in the emergency disconnect monitoring procedure, is configured to allow the power source to be restored prior to the disconnect condition has been met and thereby avoid an unnecessary disconnecting of the riser.

4. The control system according to claim 1, wherein the control system is determining drift of the vessel by monitoring the position of the vessel over time.

5. The control system according to claim 1, wherein the control system is determining drift of the vessel by determining a rate, rate of change and direction of movement of the vessel.

6. The control system according to claim 1, wherein the control system is configured to disconnect the riser system prior to or simultaneous with cutting a string accommodated in the riser system.

7. The control system according to claim 1, wherein the control system is configured to disconnect the riser system prior to or simultaneous to sealing the well bore.

8. The control system according to claim 1, wherein the critical condition of the predetermined parameter is set to protect a BOP stack, an Xmas tree or a wellhead from damages due to drift of the vessel.

9. The control system according to claim 8, wherein the predetermined parameter comprises a bend angle of the riser system.

10. The control system according to claim 1, wherein the control system is configured to determine a disconnection threshold specifying how far the vessel can drift from its target location before the critical condition is reached.

11. The control system according to claim 10, wherein the control system is configured to operate with an emergency disconnection scheme associated with an indicative time for the riser to be disconnected, and wherein the control system is configured to determine whether the vessel drifting at the determined drift will reach the disconnection threshold in a time less than the indicative time for the riser to be disconnected.

12. A method of controlling disconnection of a riser system that extends between a vessel and a subsea location that comprises a wellbore, the method comprises detecting a loss of a power source, entering, when a loss of a power source is detected, an emergency disconnect monitoring procedure in which a predetermined parameter of the riser system is monitored, and in the emergency disconnect monitoring procedure determining a position of the vessel, determining drift of the vessel, determining a value of the predetermined parameter, determining if a disconnect condition has been met based on the determined position of the vessel, the drift of the vessel, and the value of the predetermined parameter of the riser system, and disconnecting the riser system when the disconnect condition has been met.

13. The method according to claim 12, wherein the method comprises detecting, in the emergency disconnect monitoring procedure, whether the power source is still lost, and discontinuing the emergency disconnect monitoring procedure when a loss of the power source is no longer detected.

14. The method according to claim 12, wherein the method comprises determining drift of the vessel by monitoring the position of the vessel over time.

15. The method according to claim 12, wherein the method comprises disconnecting the riser system prior to or simultaneous with cutting a string accommodated in the riser system.

16. The method according to claim 12, wherein the method comprises determining a disconnection threshold specifying how far the vessel can drift from its target location before the critical condition is reached.

17. The method according to claim 12, wherein the method comprises operating with an emergency disconnection scheme associated with an indicative time for the riser to be disconnected, and wherein the control system is configured to determine whether the vessel drifting at the determined drift will reach the disconnection threshold in a time less than the indicative time for the riser to be disconnected.

18. A computer program product, the computer program product is embodied in a non-transitory tangible computer readable storage medium and adapted for controlling disconnection of a riser system that extends between a vessel and a subsea location that comprises a wellbore, the computer program product comprising computer instructions for:

detecting a loss of a power source, entering, when a loss of a power source is detected, an emergency disconnect monitoring procedure in which a predetermined parameter of the riser system is monitored, and in the emergency disconnect monitoring procedure determining a position of the vessel, determining drift of the vessel, determining a value of the predetermined parameter, determining if a disconnect condition has been met based on the determined position of the vessel, the drift of the vessel, and the value of the predetermined parameter of the riser system, and instructing the riser system to disconnect when the disconnect condition has been met.

19. A vessel comprising a riser system that extends between a vessel and a subsea location that comprises a wellbore and comprising a control system for managing an emergency disconnect monitoring procedure in case of loss of a main power source, wherein the control system is configured to, when a loss of a power source is detected, enter an emergency disconnect monitoring procedure in which a predetermined parameter of the riser system is monitored, the predetermined parameter has a critical condition; and wherein the control system, in the emergency disconnect monitoring procedure, is configured to:

determine a position of the vessel, determine drift of the vessel, determine a value of the predetermined parameter, determine if a disconnect condition has been met based on the determined position of the vessel, the drift of the vessel, and the value of the predetermined parameter of the riser system, and disconnect the riser system when the disconnect condition has been met.

20. The vessel according to claim 19, wherein the control system comprises a computer on which software on a computer program product according to claim 18 is run.

* * * * *